US008715148B2

(12) United States Patent
Totani

(10) Patent No.: US 8,715,148 B2
(45) Date of Patent: May 6, 2014

(54) PLASTIC BAG MAKING METHOD AND APPARATUS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 418 days.

(21) Appl. No.: 13/131,960

(22) PCT Filed: Sep. 25, 2009

(86) PCT No.: PCT/JP2009/066664
§ 371 (c)(1),
(2), (4) Date: Jun. 10, 2011

(87) PCT Pub. No.: WO2010/064482
PCT Pub. Date: Jun. 10, 2010

(65) Prior Publication Data

US 2011/0237414 A1 Sep. 29, 2011

(30) Foreign Application Priority Data

Dec. 2, 2008 (JP) ..... 2008-307792

(51) Int. Cl.
*B31B 1/86* (2006.01)
*B31B 1/62* (2006.01)
*B31B 19/16* (2006.01)
*B31B 19/86* (2006.01)

(52) U.S. Cl.
CPC ..... *B31B 19/16* (2013.01); *B31B 19/86* (2013.01); *B31B 2219/9087* (2013.01)
USPC ..... 493/221; 493/383

(58) Field of Classification Search
CPC ..... B31F 5/06; B29C 66/532; B29C 65/02; B31B 19/16; B31B 19/84; B31B 19/86; B31B 19/90; B31B 2219/9087; B31B 2219/9077; B31B 2219/908; B31B 2219/9022; B65D 33/12; B65D 33/065
USPC ..... 493/221, 226, 383, 380, 382
See application file for complete search history.

(56) References Cited

U.S. PATENT DOCUMENTS 3,722,377 A * 3/1973 Hayes ..... 493/221
(Continued)

FOREIGN PATENT DOCUMENTS

JP 02109868 4/1990
JP 03173633 7/1991
(Continued)

*Primary Examiner* — Hemant M Desai
(74) *Attorney, Agent, or Firm* — Kirschstein, et al.

(57) ABSTRACT

Problems concerning adhesion strength and aging time are eliminated in plastic-bag production in which a strip sheet is bonded with an adhesive and a handle is formed from the strip sheet on an outer surface of a plastic bag. Provided is a bag-making machine in which a strip sheet (17) and a web material are disposed so as to face each other and are pressed, with a high-adhesion adhesive (21) and another adhesive (25) interposed therebetween. The strip sheet (17) is provisionally fixed to the web material with the latter adhesive (25). This web material after the provisional fixing is wound on a roll, and a plastic bag is produced after lapse of an aging time for the high-adhesion adhesive (21). In this machine, the web material is supplied from the roll, and a plastic bag is produced from the web material.

7 Claims, 11 Drawing Sheets

(56) References Cited

U.S. PATENT DOCUMENTS

| | | | | | |
|---|---|---|---|---|---|
| 3,835,756 | A | * | 9/1974 | Bosse | 493/221 |
| 4,510,620 | A | * | 4/1985 | Langen et al. | 383/14 |
| 4,881,825 | A | * | 11/1989 | Olesen | 383/50 |
| 5,350,350 | A | * | 9/1994 | Maccalli | 493/221 |
| 5,382,215 | A | * | 1/1995 | Mattiebe | 493/221 |
| 5,458,723 | A | | 10/1995 | Watkins et al. | |
| 7,331,917 | B2 | | 2/2008 | Totani | |

FOREIGN PATENT DOCUMENTS

| | | |
|---|---|---|
| JP | 08085554 | 4/1996 |
| JP | 2004010055 | 1/2004 |
| JP | 2005053488 | 3/2005 |

* cited by examiner

PLASTIC BAG MAKING METHOD AND APPARATUS

This application is a continuation of 371 filing of International Patent Application PCT/JP2009/066664 filed Sep. 25, 2009, the entire content of which is expressly incorporated herein by reference thereto.

TECHNICAL FIELD

The invention relates to a method of and an apparatus for successively making plastic bags.

BACKGROUND

There has been a plastic bag including side gusset portions, as disclosed in Japanese Patent Publication No. 3,733,085. In the publication, an apparatus is arranged to successively making plastic bags by supplying continuous webs from rolls. The plastic bag is called a side gusset bag which includes panel portions and side gusset portions. The panel portions are superposed on each other to have opposite side edges along which the side gusset portions extend. The side gusset portions are folded into halves and interposed between the panel portions. The plastic bag can therefore be enlarged by the side gusset portions to obtain an increased capacity.

The plastic bag further includes a bottom gusset portion in addition to the panel portions and the side gusset portions. The continuous webs comprise panel, side gusset and bottom gusset webs. The apparatus is arranged to supply the panel, side gusset and bottom gusset webs from the rolls so that the panel portions are formed of the panel web while the side gusset portions are formed of the side gusset web. The bottom gusset portion is formed of the bottom gusset web. The continuous webs may comprise panel and side gusset webs. The apparatus is arranged to supply the panel and side gusset webs from the roils so that the panel and bottom gusset portions are formed of the panel web while the side gusset portions are formed of the side gusset web, as disclosed in Japanese Patent Publication No. 3,655,627.

In the meantime, it is often that the side gusset bag is considerable large. In this connection, the side gusset bag is too heavy to carry it when being filled with content. It is therefore required to make the side gusset bag provided with a handle to carry the side gusset bag by the handle.

By the way, it is known to wrap content with a plastic film, which is provided with a handle, as disclosed in Japanese Laid-Open Patent Publication No. H02-109,868. In the publication, the plastic film has an outer surface to which a strip sheet is adhered so that the handle can be formed of the strip sheet.

It is therefore conceivable to make a strip sheet adhered to the outer surface of the side gusset bag so that a handle can be formed of the strip sheet in the apparatus for successively making side gusset bags. However, the problem is what adhesive agent to utilize. A hot-melt or instant adhesive agent merely has an adhesive strength not enough to carry the side bag by the handle when the strip sheet is adhered to the outer surface of the side gusset bag with the hot-melt or instant adhesive agent so that the handle can be formed of the strip sheet. The handle must be peeled and separated off by weight of the side gusset bag which is too heavy, as described previously.

On the other hand, a strong adhesive agent has been commercially available. It is defined herein that the strong adhesive agent is a particular adhesive agent having an adhesive strength increased. However, it is often that the strong adhesive agent needs a curing time. In this connection, there appears almost no adhesive strength until the curing time elapses after applying the strong adhesive agent to one of the opposite surfaces of the strip sheet and making the strip sheet adhered to the outer surface of the side gusset bag. It is therefore required to keep the strip sheet and the side gusset bag from being moved for at least a time of 10 minutes after the strip sheet is adhered. The strip sheet may be deviated or peeled off if the side gusset bag is fed at a high speed before the above time elapses. It is therefore unpractical to make the strip sheet adhered with the strong adhesive agent needing the curing time in the apparatus successively making side gusset bags.

It is therefore an object of the invention to overcome the problems of adhesive strength and curing time when a handle is formed of a strip sheet adhered with a certain adhesive agent in an apparatus for successively making plastic bags.

SUMMARY OF THE INVENTION

According to the invention, there is provided a method of successively making plastic bags. The method includes preparing a continuous web along with strip sheets, the continuous web having opposite surfaces, each of the strip sheets having opposite surfaces. The method further includes applying a strong adhesive agent and an additional adhesive agent to one of the opposite surfaces of the strip sheet or the continuous web. The strong adhesive agent needs a curing time. The method further includes making the strip sheet and the continuous web opposed to and pressed against each other so that the strong adhesive agent and the additional adhesive agent can be interposed between the strip sheet and the continuous web. The strip sheet and the continuous web are temporarily fixed to each other with the additional adhesive agent. The method further includes taking up the continuous web on a roll after the strip sheet is temporarily fixed. The method further includes supplying the continuous web from the roll after the curing time elapses in an apparatus for successively making plastic bags. Each of the plastic bags includes a certain portion formed of the continuous web. The certain portion has an outer surface on which a handle is formed of the strip sheet.

In a preferred embodiment, the strip sheet and the continuous web are opposed to and pressed against each other so that the strong adhesive agent and the additional adhesive agent can be interposed between the strip sheet and the continuous web every unit length of the continuous web. The strip sheets are spaced from each other at a distance longitudinally of the continuous web and temporarily fixed to one of the opposite surfaces of the continuous web with the additional adhesive agent.

The additional adhesive agent comprises a hot-melt or instant adhesive agent.

The continuous web comprises a laminated film composed of a sealant laminated on a base film. The sealant is superposed on the strip sheet when taking up the web into the roll after the strip sheet is temporarily fixed to the base film of the continuous web.

The sealant comprises a layer of polyethylene or polypropylene.

The continuous web is fed with the base film faced upwardly and the sealant faced downwardly when supplying the continuous web from the roll. The continuous web is given a tension so that the sealant can be engaged with scraper means to scrape the strong adhesive agent or the additional adhesive agent from the sealant when the strong adhesive agent or the additional adhesive agent is attached to the sealant. The certain portion is then formed of the continuous web.

There is also proposed an apparatus for successively making plastic bags by supplying a continuous web from a roll. The apparatus is characterized in that a strip sheet and the continuous web are opposed to and pressed against each other so that a strong adhesive agent and an additional adhesive agent can be interposed between the strip sheet and the continuous web every unit length of the continuous web. The strong adhesive agent needs a curing time.

BEST MODE TO CARRY OUT THE INVENTION

Embodiments of the invention are as follows.

Figure 1:
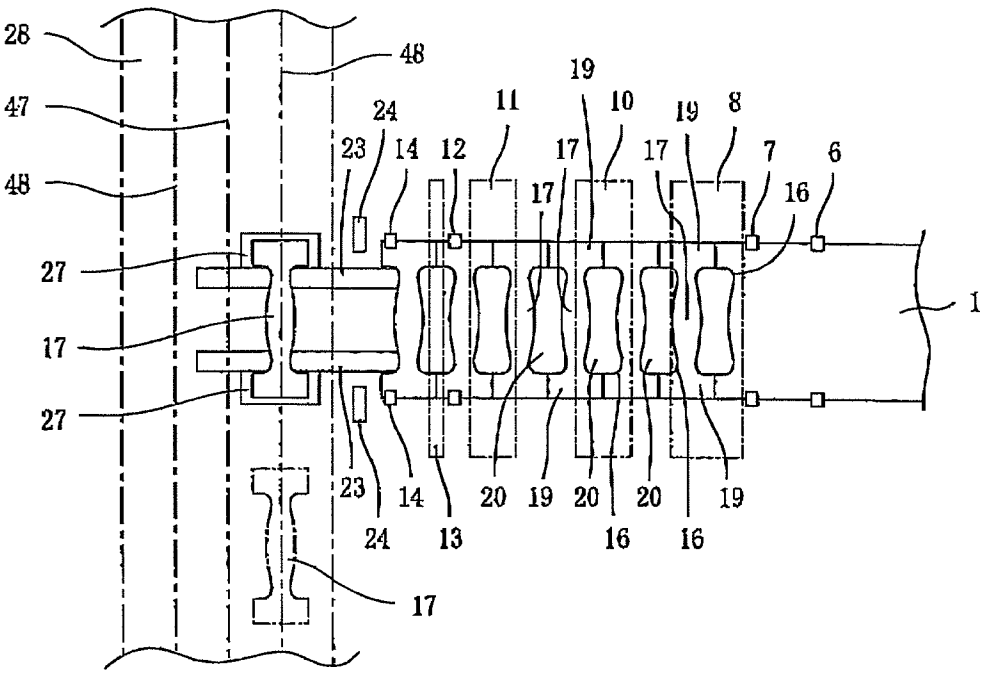
FIG. 1 is a plan view of a preferred embodiment of the invention.
Figure 2:
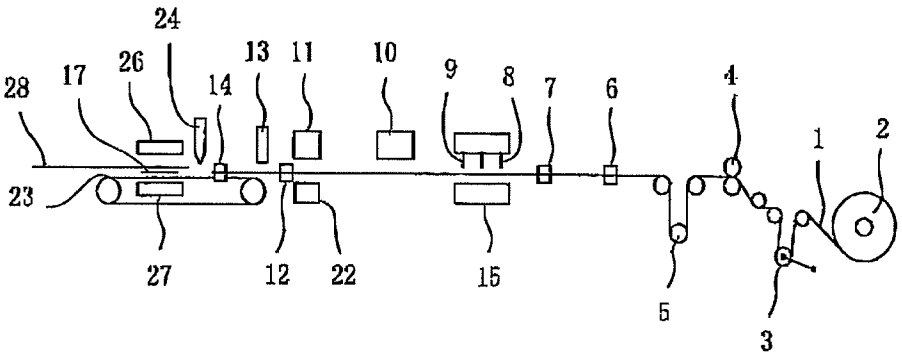
FIG. 2 is a side view of the handle web, the strip sheet and the continuous web of FIG. 1.

Turning now to the drawings, FIGS. 1 and 2 illustrate a method of successively making plastic bags according to the invention. The method includes supplying a handle web 1 from a roll 2. The handle web 1 is directed to a tension roller 3 and feed rollers 4 to be fed by the feed rollers 4. The handle web 1 comprises a plastic film. The feed rollers 4 are rotated continuously so that the handle web 1 can be fed continuously. In addition, the handle web 1 is directed to a dancer roller 5, a movable clamp 6, a fixed clamp 7, a Thomson blade 8, a perforating blade 9, an adhesive agent applicator 10, a waste removing equipment 11, a movable clamp 12, a separating equipment 13 and a fixed clamp 14. The movable clamps 6 and 12 are closed while the fixed clamps 7 and 14 are opened by actuators such as air cylinders so that the handle web 1 can be clamped by the movable clamps 6 and 12 and released from the fixed clamps 7 and 14. In addition, the movable clamps 6 and 12 are supported by timing belts which are driven by drive motor means so that the movable clamps 6 and 12 can be moved longitudinally of the handle web 1. The movable clamp 6 is moved toward the fixed clamp 7 to come near the fixed clamp 7 while the movable clamp 12 is moved toward the fixed clamp 14 to come near the fixed clamp 14. The movable clamps 6 and 12 are moved for the same distance as each other. The handle web 1 is therefore pulled and fed by the movable clamps 6 and 12. The fixed clamps 7 and 14 are then closed while the movable clamps 6 and 12 are opened by the actuators so that the handle web 1 can be clamped by the fixed clamps 7 and 14 and released from the movable clamps 6 and 12. The movable clamps 6 and 12 are then moved reversely to return to the original positions. The handle web 1 is then clamped by the movable clamps 6 and 12 and released by the fixed clamps 7 and 14, the movable clamps 6 and 12 being moved again. The steps are performed alternately and repeatedly so that the handle web 1 can be fed intermittently. The dancer roller 5 is moved upwardly and downwardly with a tension so that the handle web 1 can be fed from and accumulated by the dancer roller 5.

Figure 3:
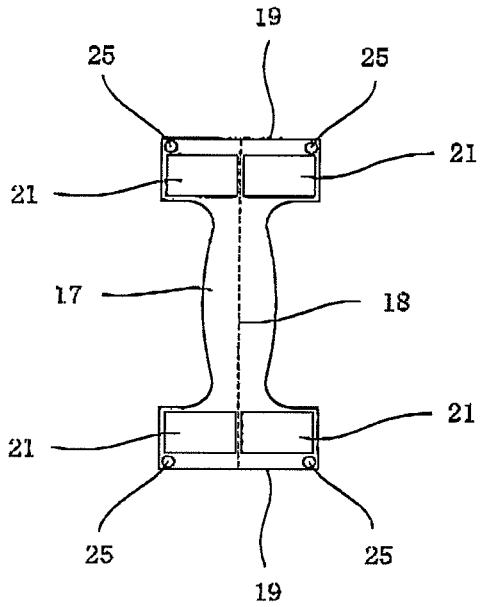
FIG. 3 is an enlarged view of the strip sheet of FIG. 1.

The Thomson blade 8 is pressed against the handle web 1 and a receiver 15 so that the handle web 1 can be cut along a cut line 16 into a strip sheet 17 when the handle web 1 is stopped whenever being fed intermittently. At the same time, the perforating blade 9 is pressed against the handle web 1 and the receiver 15 so that a perforation 18 can be formed in the strip sheet 17, as shown in FIG. 3. The strip sheet 17 therefore comprises the plastic film. In addition, the cut line 16 is discontinuous to have micro joints spaced from each other. The strip sheet 17 has a shape including opposite end portions 19 which are large in width. It should therefore understood that the strip sheet 17 and a waste 20 are formed in the handle web 1 whenever the handle web 1 is fed intermittently. The handle web 1 is then fed intermittently with the strip sheet 17 and the waste 20 connected with each other by the micro joints. The method therefore includes preparing the strip sheets 17, each of the strip sheets 17 having opposite surfaces.

The method further includes supplying a strong adhesive agent 21 from the applicator 10 to apply the strong agent 21 to one of the opposite surfaces of the strip sheet 17 when the handle web 1 is stopped whenever being fed intermittently. In addition, the removing equipment 11 is pressed against the handle web 1 and a receiver 22 so that the waste 20 can be pushed downwardly by the removing equipment 11, the micro joints being broken, the waste 20 being removed and dropped downwardly. The handle web 1 is then kept being sandwiched between the removing equipment 11 and the receiver 22. In addition, the separating equipment 13 is pressed against the handle web 1 between the removing equipment 11 and the fixed clamp 14 so that the handle web can be pushed downwardly by the separating equipment 13, the micro joints being broken, the strip sheet 17 being separated from the next one.

The strip sheet 17 is attached by vacuum to suction belts 23 when the movable clamp 12 is closed and the fixed clamp 14 is opened after the strip sheet 17 is separated. The suction belts 23 are then driven by a motor so that the strip sheet 17 can be fed for a distance. The strip sheet 17 passes through an applicator 24 when being fed. Furthermore, the method includes spraying an additional adhesive agent 25 from the applicator 24 to apply the additional adhesive agent 25 to one of the opposite surfaces of the strip sheet 17 when the strip sheet 17 is fed.

In the embodiment, the applicators 10 and 24 are disposed over the strip sheet 17 to apply the strong adhesive agent 21 and the additional adhesive agent 25 to the upper surface of the strip sheet 17. In addition, a retainer 26 is disposed over receivers 27 so that the strip sheet 17 can be fed by the suction belts 23 to be disposed between the retainer 26 and the receivers 27.

The applicators 10 and 24 are arranged to apply the strong adhesive agent 21 over a considerable area in the opposite end portions 19 of the strip sheet 17 and apply the additional adhesive agent 25 at the corners of the opposite end portions 19. The strong adhesive agent 21 is of a type needing a curing time. The additional adhesive agent 25 comprises a hot-melt or instant adhesive agent.

Figure 5:
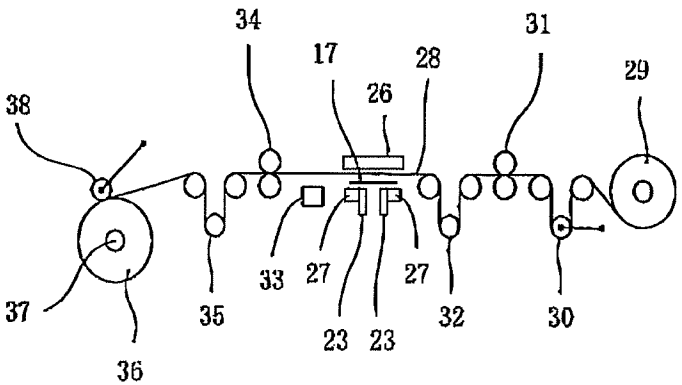
FIG. 5 is an elevational view of the continuous web of FIG. 2.

The method further includes preparing a continuous web 28 by supplying the continuous web 28 from a roll 29, as shown in FIG. 5, the continuous web 28 having opposite surfaces. The continuous web 28 is directed to a tension roller 30 and feeding rollers 31 to be fed by the feeding rollers 31.

The feeding rollers 31 are rotated continuously so that the continuous web 28 can be fed continuously. The continuous web 28 is then directed to a dancer roller 32 and interposed between the retainer 26 and the receivers 27. In this connection, it should be understood that the strip sheet 17 is fed by the suction belts 23 to be interposed between the retainer 26 and the receivers 27, as described previously, and disposed under the continuous web 28 interposed between the retainer 26 and the receivers 27. In addition, the continuous web 28 is directed to a mark sensor 33 and feeding rollers 34 to be fed by the feeding rollers 34. The continuous web 28 has a mark put on the outer surface thereof every unit length of the continuous web 28. The mark sensor 33 is arranged to detect the mark and generate a signal. The feeding rollers 34 are stopped by a control device in response to the signal, the continuous web 28 being also stopped.

The retainer 26 is then pushed downwardly by drive means to be pressed against the continuous web 28, the strip sheet 17 and the receivers 27. The strip sheet 17 and the continuous web 28 are therefore opposed to and pressed against each other so that the strong adhesive agent 21 and the additional adhesive agent 25 can be interposed between the strip sheet 17 and the continuous web 28. The strip sheet 17 and the continuous web 28 are temporarily fixed to each other with the additional adhesive agent 25. Specifically, the strip sheet 17 is temporarily fixed to one of the opposite surfaces of the continuous web 28 with the additional adhesive agent 25. In the embodiment, the strip sheet 17 is temporarily fixed to the lower surface of the continuous web 28. In addition, the strip sheet 17 and the continuous web 28 are kept being sandwiched between the retainer 26 and the receiver 27 after the retainer 26 is pressed against the continuous web 28, the strip sheet 17 and the receivers 27. The receivers 27 are then pushed upwardly while the retainer 26 is pulled upwardly by drive means so that the continuous web 28 and the strip sheet 17 can be pulled upwardly by the retainer 26 and the receivers 27, the strip sheet 17 being torn from the suction belts 23. The retainer 26 and the receivers 27 are then returned to the original positions.

The feeding rollers 34 are then rotated by the control device so that the continuous web 28 can be fed again. The strip sheet 17 is also fed by the suction belts 23. The feeding rollers 34 and the continuous web 28 are then stopped again, the strip sheet 17 being temporarily fixed again. In such the way, the feeding rollers 34 are rotated intermittently so that the continuous web 28 can be fed intermittently. The strip sheet 17 and the continuous web 28 are temporarily fixed to each other when the continuous web 28 is stopped whenever being fed intermittently. In addition, the dancer roller 32 is moved upwardly and downwardly with a tension when the continuous web 28 is fed intermittently so that the continuous web 28 can be fed from and accumulated by the dancer roller 32.

It should therefore be understood that the strip sheet 17 and the continuous web 28 are opposed to and pressed against each other so that the strong adhesive agent 21 and the additional adhesive agent 25 can be interposed between the strip sheet 17 and the continuous web 28 every unit length of the continuous web 17. The strip sheets 17 are spaced from each other at a distance longitudinally of the continuous web 28 and temporarily fixed to one of the opposite surfaces of the continuous web 28 with the additional adhesive agent 25.

In addition, the strip sheet 17 goes widthwise thereof when being fed by the suction belts 23. The continuous web 28 goes perpendicularly to the feeding direction of the strip sheet 17 when being fed by the feeding rollers 34. The strip sheet 17 therefore extends longitudinally of the continuous web 28 when being temporarily fixed to one of the opposite surfaces of the continuous web 28.

The continuous web 28 is then directed to a dancer roller 35 and a roll 36. In addition, for example, a drive motor is connected to a powder clutch and a shaft 37 so that the shaft 37 can be rotated by the drive motor and the powder clutch to take up the continuous web 28 on the roll 36 after the strip sheet 17 is temporarily fixed. The shaft 37 is rotated continuously to take up the continuous web 28 continuously. The dancer roller 35 is moved upwardly and downwardly so that the continuous web 28 can be fed from and accumulated by the dancer roller 35. A touch roller 38 is engaged with the web 28 and the roll 36 to take up the continuous web 28 exactly with a contact pressure. The roll 36 increases in diameter. In this connection, it is practical to utilize the touch roller 38 to measure the diameter so that the drive motors, the feeding rollers 31, 34 and the shaft 37 can be stopped by the control device when the diameter reach a predetermined value.

In the embodiment, the strip sheet 17 is temporarily fixed to the lower surface of the continuous web 28, as described previously. The continuous web 28 comprises a laminated film composed of a sealant laminated on a base film. In addition, the continuous web 28 is fed with the base film faced downwardly and the sealant faced upwardly. The sealant is therefore superposed on the strip sheet 17 when taking up the continuous web 28 on the roll 36 after the strip sheet 17 is temporarily fixed to the base film of the continuous web 28. The base film comprises of a layer of nylon or PET while the sealant comprises a layer of polyethylene or polypropylene.

Figure 6:
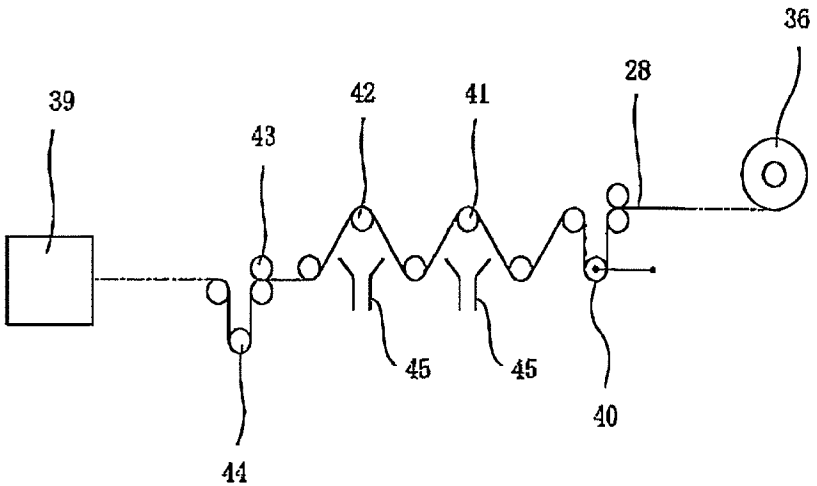
FIG. 6 is an explanatory view of the continuous web of FIG. 5 when supplying it.

Furthermore, taking into account the strong adhesive agent 21 needing the curing time, the method further includes supplying the continuous web 28 from the roll 36 after the curing time elapses in an apparatus for successively making plastic bags, as shown in FIG. 6. For example, it is practical to supply the continuous web 28 from the roll 36 more than half an hour later in the apparatus. The apparatus includes a support on which the roll 36 is installed to supply the continuous web 28. The continuous web 28 is directed to equipments 39. The equipments 39 include feeding rollers, heat seal means and a cutter, by which continuous webs are fed, heat sealed and cut.

In the embodiment, the continuous web 28 is fed with the base film faced upwardly and the sealant faced downwardly when supplying the continuous web 28 from the roll 36. In addition, the continuous web 28 is directed to a tension roller 40 to be given a tension. The continuous web 28 then passes through scraper means 41 and 42 to be directed to and fed by feeding rollers 43 so that the sealant can be engaged with the scraper means 41 and 42. The feeding rollers 43 are rotated continuously so that the continuous web 28 can be fed continuously. The scraper means 41 and 42 comprises chrome-plated rollers which are not rotated to scrape the strong adhesive agent 21 or the additional adhesive agent 25 from the sealant when the strong adhesive agent 21 or the additional adhesive agent 25 is attached to the sealant. The arrangement scrapes the attached adhesive agent 21 or 25 several times. The continuous web 28 then passes through a dancer roller 44 to be directed to the equipments 39. In addition, hoppers 45 are disposed under the scraper means 41 and 42 and connected to a blower so that the scraped adhesive agent can be absorbed and discharged into the hoppers 45 and the blower.

Figure 7:
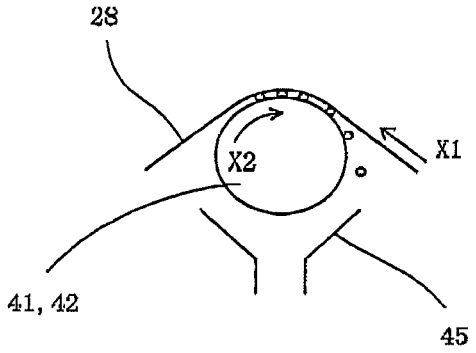
FIG. 7 is an explanatory view of another embodiment.
Figure 8:
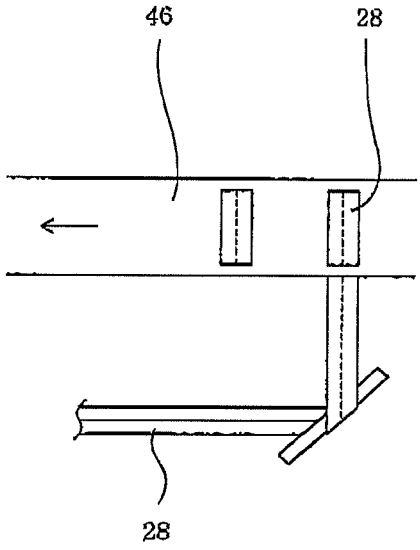
FIG. 8 is an explanatory view of the continuous web of FIG. 6 which comprises a side gusset web fed to the panel web.

The continuous web 28 is fed in a direction X1, as shown in FIG. 7. The scraper means 41 and 42 may comprise chrome-plated rollers which are rotated in a direction X2 opposite to the direction X1. This arrangement can scrape the attached adhesive agent effectively even if the tension is low. The scraper means 41 and 42 may comprise brush rollers.

Figure 9:
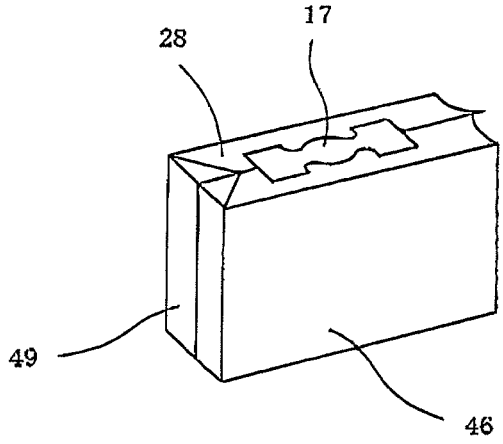
FIG. 9 is a perspective view of the plastic bag obtained by the apparatus of FIG. 6.

The continuous web 28 is then directed to the equipments 39 in which the continuous web 28 is fed, heat sealed and cut by the feeding rollers, the heat seal means and the cutter to successively make plastic bags. Each of the plastic bags includes a certain portion formed of the continuous web 28. In the embodiment, the continuous web 28 comprises a side gusset web. The apparatus is arranged to supply a continuous web 46 from a roll in addition to the side gusset web 28, the continuous web 46 comprising a panel web. The side gusset web 28 is folded into halves on the opposite sides of the centerline thereof and cut into a strip sheet which is fed to and put on the panel web 46, as in the case of the apparatus of Japanese Patent No. 3,733,085. The side gusset web 28 has a centerline 47 and folded lines 48 to be folded into halves along the folded lines 48. The strip sheet 17 is folded into halves along the perforation 18 when the side gusset web 28 is folded. The plastic bag therefore includes panel portions one of which is formed of the panel web 46, as shown in FIG. 9. The plastic bag further includes side gusset portions formed of the side gusset web 28. The apparatus may be arranged to supply a continuous web 49 from a roll, the continuous web 49 comprising a bottom gusset web. The plastic bag includes a bottom gusset portion formed of the bottom gusset web 49. The panel portion and the bottom gusset portion may be formed of the panel web while the side gusset portions is formed of the side gusset web 28, as in the case of the apparatus of Japanese Patent No. 3,655,627.

Each of the panel web 46 and the bottom gusset web 49 also comprises a laminated film composed of a sealant laminated on a base film as the side gusset web 28. Each of the panel portions, the side gusset portions and the bottom gusset portion has outer and inner surfaces, the outer surface being formed of the base film, the inner surface being formed of the sealant. In addition, a handle 17 is formed of the strip sheet 17 on the outer surface. In the embodiment of FIG. 9, the side gusset portion is formed of the side gusset web 28 to have an outer surface on which the handle 17 is formed of the strip sheet 17.

In the method, the strip sheet 17 and the continuous web 28 are temporarily fixed to each other with the additional adhesive agent 25 before taking up the continuous web 28 on the roll 36. The method therefore has no problem of the strip sheet 17 being peeled off. The strip sheet 17 cannot be peeled off the continuous web 28 when and until taking up the continuous web 28 on the roll 36.

In addition, the strip sheet 17 is kept being sandwiched between the turns of the continuous web 28 after taking up. The continuous web 28 may be given a tension when taking up so that the strip sheet 17 can be compressed between the turns of the continuous web 28 with an adequate pressure. The pressure may be adjusted by the tension. The strip sheet 17 and the continuous web 28 can therefore be kept being pressed against each other. In addition, taking into account the strong adhesive agent 21 needing the curing time, it is intended to then supply the continuous web 28 from the roll 36 after the curing time elapses in the apparatus for successively making plastic bags, as described previously.

The strip sheet 17 and the continuous web 28 have therefore been adhered to each other not only with the additional adhesive agent 25 but also with the strong adhesive agent 21 when supplying the continuous web 28 from the roll 36. The method can therefore obtain sufficient adhesive strength without the problem of curing time. The handle cannot peeled and separated off by weight when carrying the plastic bag by the handle formed of the strip sheet 17. There is no problem of adhesive strength.

Figure 4:
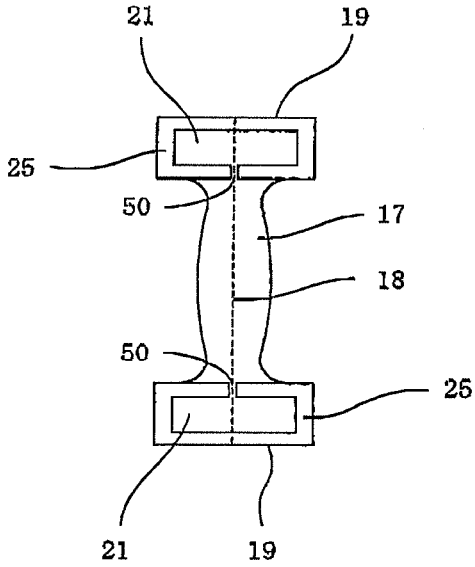
FIG. 4 is an enlarged view of another embodiment.

The strong adhesive agent 21 may be got out about the strip sheet 17 by pressure when being sandwiched between the turns of the continuous web 28 after taking up the continuous web 28 on the roll 36. It is therefore preferable to apply the strong adhesive agent 21 to one of the opposite surfaces of the strip sheet 17 within an area predetermined to keep the strong adhesive agent 21 from being got out about the strip sheet 17 by pressure. It is practical to apply the additional adhesive agent 25 around the strong adhesive agent 21 so that the additional adhesive agent 25 can keep the strong adhesive agent 21 from being got out around the strip sheet 17, as shown in FIG. 4. It is also practical not to apply the additional adhesive agent 25 to a fixed portion 50 so that the strong adhesive agent 21 can go into the center portion of the strip sheet 17 through the fixed portion 50.

The sealant is superposed on the strip sheet 17 when taking up the continuous web 28 on the roll 36, as described previously. It does therefore not matter if the strong adhesive agent 21 is got out about the strip sheet 17. The sealant acts as an exfoliate paper to be peeled off the got out adhesive agent when supplying the continuous web 28 from the roll 36. The method can therefore unwind and supply the continuous web 28 from the roll 36 smoothly. The sealant comprises the layer of polyethylene or polypropylene, as also described previously. In this case, it is confirmed that the sealant is peeled off the got out adhesive agent smoothly to unwind and supply the continuous web 28 from the roll 36 smoothly.

In addition, the got out adhesive agent is hardly attached to the sealant when supplying the continuous web 28 from the roll 36. Furthermore, the scraper means 41 and 42 then scrape the got out adhesive agent, as also described previously. Accordingly, there remains no got out adhesive agent in the plastic bag having outer and inner surfaces, the outer surface being formed of the base film, the inner surface being formed of the sealant.

Figure 10:
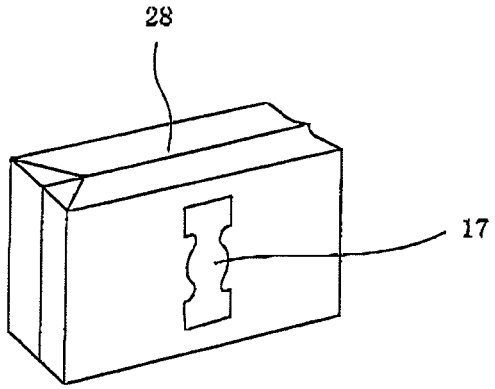
FIG. 10 is a perspective view of another embodiment.
Figure 11:
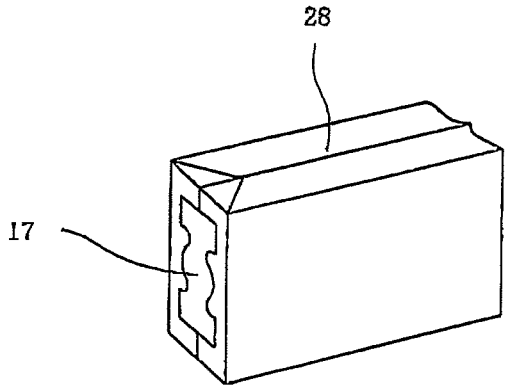
FIG. 11 is a perspective view of another embodiment.

It is practical to apply the strong adhesive agent 21 and the additional adhesive agent 25 to one of the opposite surfaces of the continuous web 28, as opposed to the embodiment of applying the strong adhesive agent 21 and the additional adhesive agent 25 to one of the opposite surfaces of the strip sheet 17. The strip sheet 17 may be adhered to one of the opposite surfaces of the continuous web comprising not the side gusset web but the panel or bottom gusset web so that the panel or bottom gusset portion can have the outer surface on which the handle is formed of the strip sheet 17, as shown in FIGS. 10 and 11.

What is claimed is:

1. A method of successively making plastic bags comprising:

preparing a continuous web along with strip sheets, the continuous web having opposite surfaces, each of the strip sheets having opposite surfaces;

applying a strong adhesive agent and an additional adhesive agent to one of the opposite surfaces of the strip sheet or the continuous web, the strong adhesive agent needing a curing time;

making the strip sheet and the continuous web opposed to and pressed against each other so that the strong adhesive agent and the additional adhesive agent can be interposed between the strip sheet and the continuous web, the strip sheet and the continuous web being temporarily fixed to each other with the additional adhesive agent;

taking up the continuous web on a roll after the strip sheet is temporarily fixed; and supplying the continuous web from the roll after the curing time elapses in an apparatus for successively making plastic bags, each of the plastic bags including a certain portion formed of the continuous web, the certain portion having an outer surface on which a handle is formed of the strip sheet.

2. The method as set forth in claim 1 wherein the strip sheet and the continuous web are opposed to and pressed against each other so that the strong adhesive agent and the additional adhesive agent can be interposed between the strip sheet and the continuous web every unit length of the continuous web, the strip sheets being spaced from each other at a distance longitudinally of the continuous web and temporarily fixed to one of the opposite surfaces of the continuous web with the additional adhesive agent.

3. The method as set forth in claim 1 wherein the additional adhesive agent comprises a hot-melt or instant adhesive agent.

4. The method as set forth in claim 1 wherein the continuous web comprises a laminated film composed of a sealant laminated on a base film, the sealant being superposed on the strip sheet when taking up the continuous web on the roll after the strip sheet is temporarily fixed to the base film of the continuous web.

5. The method as set forth in claim 4 wherein the sealant comprises a layer of polyethylene or polypropylene.

6. The method as set forth in claim 4 wherein the continuous web is fed with the base film faced upwardly and the sealant faced downwardly when supplying the continuous web from the roll, the continuous web being given a tension so that the sealant can be engaged with scraper means to scrape the strong adhesive agent or the additional adhesive agent from the sealant when the strong adhesive agent or the additional adhesive agent is attached to the sealant, the certain portion being then formed of the continuous web.

7. An apparatus for successively making plastic bags by supplying a continuous web from a roll, the apparatus being characterized in that the roll is acquired by taking up the continuous web after a strip sheet and the continuous web are opposed to and pressed against each other so that a strong adhesive agent and an additional adhesive agent can be interposed between the strip sheet and the continuous web every unit length of the continuous web, the strong adhesive agent needing a curing time, the strip sheets being adhered to one of the opposite surfaces of the continuous web not only with the additional adhesive agent but also with the strong adhesive agent when supplying the continuous web from the roll.

* * * * *